US005680675A

United States Patent [19]

Davis

[11] Patent Number: 5,680,675

[45] Date of Patent: Oct. 28, 1997

[54] BI-FOLD DOOR SAFETY WEDGE

[76] Inventor: James P. Davis, 2114 Kensington Dr., Schaumburg, Ill. 60194

[21] Appl. No.: 632,214

[22] Filed: Apr. 15, 1996

[51] Int. Cl.[6] ..... E05F 5/04; E05D 11/00

[52] U.S. Cl. ..... 16/83; 16/86 R; 16/86 B; 49/383; 292/343; 292/DIG. 17

[58] Field of Search ..... 16/82, 83, 86 R, 16/86 B; 292/288, 343, DIG. 17; 49/383; 160/233

[56] References Cited

U.S. PATENT DOCUMENTS

| | | | |
|---|---|---|---|
| 3,137,025 | 6/1964 | Howard | 16/83 |
| 3,325,854 | 6/1967 | Steigerwald | 16/86 B |
| 4,368,555 | 1/1983 | Salerno | 16/83 |
| 4,648,152 | 3/1987 | Grewall | 292/DIG. 17 |
| 5,369,840 | 12/1994 | Salvador et al. | 16/83 |
| 5,509,235 | 4/1996 | Chander | 292/343 |
| 5,511,837 | 4/1996 | Dempsey et al. | 292/343 |

*Primary Examiner*—Chuck Y. Mah
*Assistant Examiner*—Donald M. Gurley
*Attorney, Agent, or Firm*—Meroni & Meroni

[57] ABSTRACT

A pivotal sliding bi-fold door structure mounted in a door frame having a track slidably accommodating the bi-fold door structure. The bi-fold door structure comprising at least two door panels pivotally connected by a hinge member. The improvement comprising a bi-fold door safety wedge including a main body structure. A pair of non-parallel edges on opposite sides of the main body structure facing away from each other and extending along the main body structure and nearly intersect to form a vertex at a front portion of the main body structure. Another edge extending between the non-parallel edges at a back portion of the main body structure. An elastic strap for removably elastically securing the main body structure to the hinge member, where the removable elastic securing strap has the characteristic of adjustably positioning the vertex of the main body structure in adjacency with the hinge member when the bi-fold door structure is in an open position. A non-slip surface portion located along the main body structure co-extensive with the pair of non-parallel edges thereby aiding to maintain an operational wedge-stopped position. The removable elastic securing strap further having the characteristic of enabling manual positioning of the main body structure to a non-wedged position adjacent a front side of the door panels thereby enabling the bi-fold door structure to be movable into the fully closed position.

17 Claims, 2 Drawing Sheets

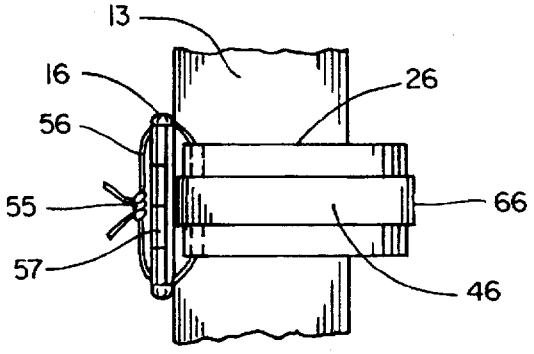
Fig. 4
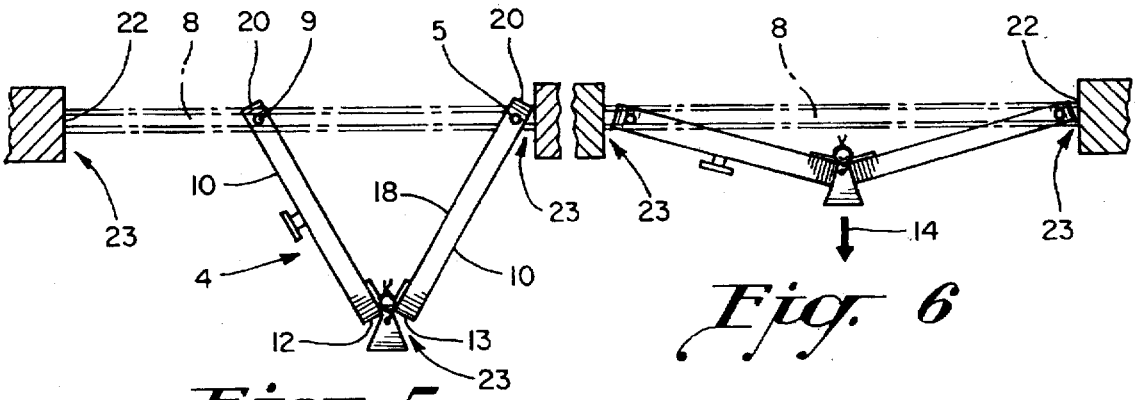
Fig. 5
Fig. 6
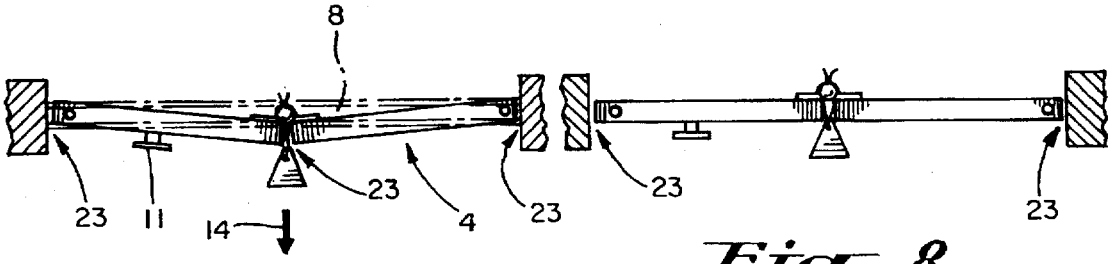
Fig. 7
Fig. 8

BI-FOLD DOOR SAFETY WEDGE

BACKGROUND OF THE INVENTION

1. Field of the Invention

The present invention relates generally to door safety stop devices. More specifically, it relates to a bi-fold door safety wedge used in combination with multi-panel doors, namely, bi-fold doors, to prevent injuries to small children's fingers, hands, and other extremities when the child shuts the doors without adult supervision, often pinching an extremity in the space between the closing doors or in the space between the doors and the door frame, thereby injuring themselves, sometimes severely.

2. Description of the Prior Art

The closing of all kinds of doors has always presented problems for small children, in particular, and for all persons who inadvertently close a door in a hurry without being sure that theirs, as well as other's, fingers, hands, and other extremities are out of the way of the moving door and its parts as the door closes. U.S. Pat. No. 4,368,555 recognizes this problem and sets forth a solution to prevent track sliding doors from being closed on an individual's fingers where the leading edge of the door abuts against the door frame when in a fully closed position.

After extensively researching the marketplace and the U.S. Patent and Trademark Office Records, however, no such device has been disclosed to address the door closing problem for a multi-panel door, namely a bi-fold door. In a bi-fold door there are "pinch areas" located at both sides of the door panels where they abut the door frame when in a fully closed position, as well as between the door panels themselves. These "pinch areas" create three times the risk of injury to a child or inadvertent user each and every time the bi-fold door is closed.

My bi-fold door safety wedge will prevent pinched or injured fingers, hands, or other extremities by automatically engaging to a wedge-stopping position whenever the bi-fold doors are opened. Then, in order for the bi-fold doors to be fully closed again the bi-fold door safety wedge must be manually moved to a non-wedged position, where the bi-fold door safety wedge rests awaiting automatic engagement once the bi-fold doors are opened again.

More and more bi-fold doors are becoming a part of every home. In particular, they are used as closet doors because they are easy to install, require little maintenance and most of all, they utilize space more efficiently than traditional single panel, side mounted, hinge hung doors. My bi-fold door safety wedge takes advantage of the existing structural features of the bi-fold door by being easily removably secured to the bi-fold door at a hinge member that connects two door panels comprising the bi-fold door. My bi-fold door safety wedge does not require any structural modification to the bi-fold door or its parts or require permanently securing the bi-fold door safety wedge to any part of the bi-fold door or the door frame. Moreover, the bi-fold door safety wedge can be secured to any of the two or more hinge members fitted between the door panels and still achieve all of the advantages of my invention. Further, this versatility allows optional securement of the bi-fold door safety wedge to a hinge member located higher up on the bi-fold door, out of the reach of small children.

Finally, given the quick and easy installation features of my invention together with the simple economical construction of my bi-fold door safety wedge, it will be a product that everyone can afford to own. With my bi-fold door safety wedge, once and for all we can eliminate the risk of injury when closing bi-fold doors, for children and adults alike.

These and other types of door safety devices disclosed in the prior art do not offer the flexibility and inventive features of my bi-fold door safety wedge. As will be described in greater detail hereinafter, the bi-fold door safety wedge. As will be described in greater detail herein after, of the preset invention differs from those previously proposed.

SUMMARY OF THE INVENTION

According to my present invention I have provided, in combination, a bi-fold door safety wedge and a pivotal sliding bi-fold door mounted in a door frame having a track slidably accommodating the bi-fold door. The bi-fold door comprises at least two door panels. Each door panel has an abutting longitudinal edge. Each abutting longitudinal edge pivotally connects to another abutting longitudinal edge by a hinge member fitted therebetween and located adjacent a back side of the door panel. Each door panel further has a longitudinal leading edge facing away from the abutting longitudinal edge. The longitudinal leading edge abuts a leading surface in the door frame when the bi-fold door is in a fully closed position. The bi-fold door safety wedge comprises a main body structure. The main body structure is defined by a pair of non-parallel edges on opposite sides of the main body structure facing away from each other and extending along the main body structure. The main body structure is further defined by one other edge extending between the non-parallel edges at a back portion of the main body structure. The pair of non-parallel edges nearly intersect to form a vertex or preferred snub-nosed vertex at a front portion of the main body structure.

According to another aspect of my present invention I have provided, a pivotal sliding bi-fold door structure mounted in a door frame having a track slidably accommodating the bi-fold door structure. The bi-fold door structure comprises at least two door panels. Each door panel has an abutting longitudinal edge. Each abutting longitudinal edge pivotally connects to another abutting longitudinal edge by a hinge member fitted therebetween and located adjacent a back side of the door panel. Each door panel further has a longitudinal leading edge facing away from the abutting longitudinal edge. The longitudinal leading edge abuts a leading surface in the door frame when the bi-fold door structure is in a fully closed position. The improvement comprises a bi-fold door safety wedge including a main body structure. The main body structure is defined by a pair of non-parallel edges on opposite sides of the main body structure facing away from each other and extending along the main body structure. The main body structure is further defined by another edge extending between the non-parallel edges at a back portion of the main body structure. The pair of non-parallel edges nearly intersect to form a vertex or preferred snub-nosed vertex at a front portion of the main body structure.

Another feature of my invention relates to the means for removably elastically securing the main body structure to the hinge member fitted between respective pivotally connected abutting longitudinal edges in the door panels. The removably elastically securing means has the characteristic of adjustably positioning the vertex of the main body structure in adjacency with the hinge member when the bi-fold door is in an open position. The removably elastically securing means further having the characteristic of enabling manual positioning of the main body structure to a non-wedged position adjacent a front side of the door panels thereby enabling the bi-fold door to be movable into the fully closed position with each abutting longitudinal edge being adjacent each respective abutting longitudinal edge and each longitudinal leading edge being adjacent each respective leading surface.

Still another feature of my invention concerns a non-slip surface portion located along the main body structure co-extensive with the pair of non-parallel edges, the non-slip surface portion being contiguous with each abutting longitudinal edge when the main body structure is removably elastically secured to the hinge member and the bi-fold door is in a wedge-stopped position with the vertex adjacent the hinge member.

According to important features of my invention I have also provided the main body structure being a single piece construction of uniform composition comprising a rubber material.

Yet another feature of my invention I have provided the removably elastically securing means comprising an elastic strap. The elastic strap being loopable through a hole in the front portion of the main body structure and thereby being connected to the main body structure.

According to still further features of my invention I have also provided is the elastic strap being manually securable to the hinge member. Further, the elastic strap has a range of elasticity enabling snug positioning of the snub-nosed vertex in adjacency with the hinge member when the bi-fold door is in the open position while the elastic strap concurrently enables the snub-nosed vertex of the main body structure to be manually positioned out of adjacency with the hinge member to the non-wedged position in adjacency with the front surface of the door panels. Such range of elasticity allows the bi-fold door to be moved into the fully closed position yet allowing the elastic strap to remain secured to the hinge member and connected to the main body structure while being stretched between each abutting longitudinal edge that is adjacent each respective abutting longitudinal edge.

Yet another feature of my invention I have provided is the main body structure being a material from the group consisting of wood and synthetic plastic and the non-slip surface portion comprising a rubber belt encircling the longitudinal circumference of the main body structure.

Other objects, features and advantages of my invention will become more readily apparent upon reference to the following description when taken in conjunction with the accompanying drawings, which drawings illustrate several embodiments of my invention.

DESCRIPTION OF THE DRAWINGS

FIG. 4 is an exploded fragmentary side perspective view of an alternative embodiment of my bi-fold door safety wedge removably secured to a hinge member in combination with a bi-fold door or bi-fold door structure;

FIG. 5 is a reduced size top view of my bi-fold door safety wedge shown in FIG. 3 showing the door in an open position;

FIG. 6 is a reduced size top view of my bi-fold door safety wedge shown in FIG. 5 showing the door in another open position as it moves toward a fully closed position;

FIG. 7 is a reduced size top view of my bi-fold door safety wedge shown in FIG. 6 showing the door in another open position as it moves even closer to a fully closed position; and, FIG. 8 is a reduced size top view of my bi-fold door safety wedge shown in FIG. 7 showing the door in a fully closed position.

DETAILED DESCRIPTION OF THE PREFERRED EMBODIMENT

Figure 3:
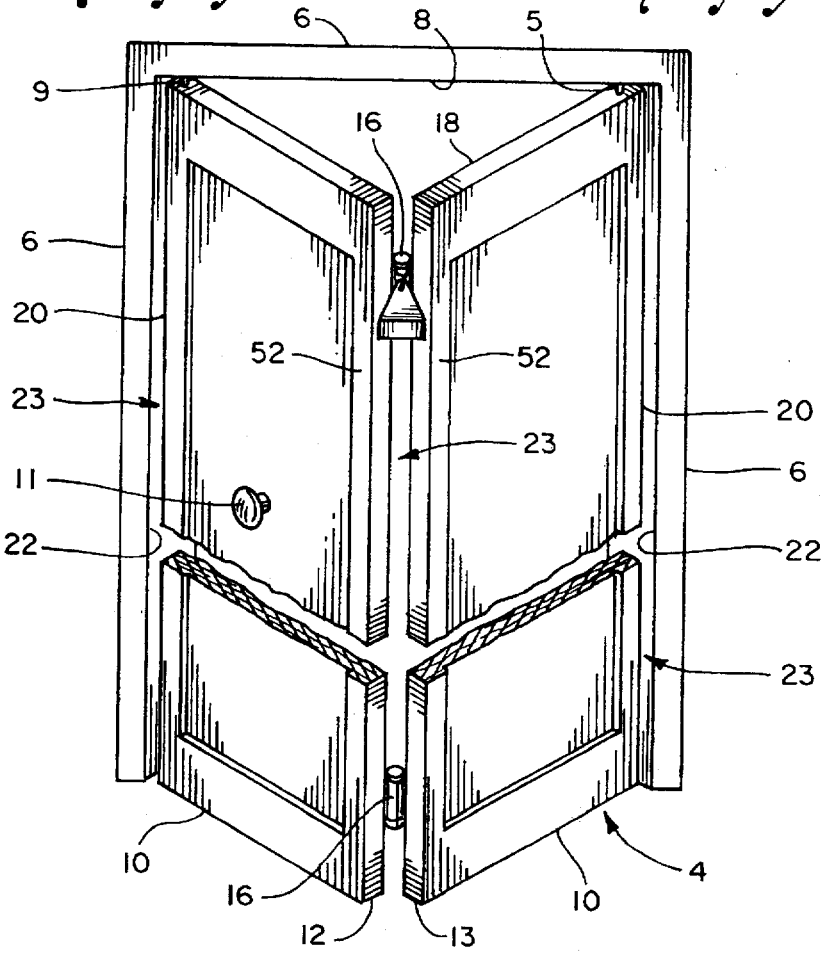
FIG. 3 is a reduced size back view of my bi-fold door safety wedge shown in FIG. 1, now removably secured to a hinge member in combination with a bi-fold door or bi-fold door structure in an open position.

Referring now to FIG. 3, shows my new and improved bi-fold door safety wedge 2 operating in combination with a pivotal sliding bi-fold door or pivotal sliding bi-fold door structure 4 mounted in a door time 6 having a track 8 slidably accommodating the bi-fold door or bi-fold door structure 4. The bi-fold door is fixedly mounted in the track 8 at a first pivot 5 and is slidably mounted in the track 8 at a second pivot 9. The bi-fold door comprises at least two door panels 10. Each door panel 10 has an abutting longitudinal edge 12 and each abutting longitudinal edge 12 is pivotally connected to another abutting longitudinal edge 13 by a hinge member 16 fitted therebetween.

The door panel 10 that is not fixedly mounted, this could be either respective door panel 10 depending on the user's desired opening direction, has attached a pull knob 11 on a front side 52 for manually opening and closing the bi-fold door in the door frame. In most existing bi-fold door constructions, and namely my contemplated invention set forth here, the hinge member 16 is located adjacent a back side 18 of the door panel 10. The exact location of the hinge member 16 is not critical as long as it is set back a sufficient distance from a front side 52 of the door panel 10 to enable a from portion 40 of the main body structure 26 to be positioned in relative adjacency with the hinge member in a wedge-stopped position when the bi-fold door is in any number of open positions, as shown in FIGS. 3–6, thereby preventing the bi-fold door from being moved to a fully closed position unintentionally.

Each door panel 10 further has a longitudinal leading edge 20 facing away from the respective abutting longitudinal edges 12 and 13, where the longitudinal leading edge 20 abuts against a leading surface 22 in the door frame 6 when the bi-fold door 4 is in the fully closed position, as shown in FIG. 8. When the bi-fold door is in one of the open positions, as depicted in FIGS. 3–7 and it is being manually positioned from the open position shown in FIG. 5 to a progressively less open position shown in FIGS. 6 and 7 and finally into the fully closed position shown in FIG. 8, there are pinch areas 23 created.

Stated differently, as the bi-fold door is manually positioned from the open position to the fully closed position, the abutting longitudinal edge 12 pivots toward the other abutting longitudinal edge 13 creating a pinch area 23 between these respective edges. Contemporaneously, the longitudinal leading edge 20 approaches leading surface 22 closing the distance between the edge 20 and the surface 22 thereby creating another pinch area 23. To an operator of the bi-fold door, a finger, hand or other extremity unintentionally located in the pinch areas 23 when the door is moved into the fully closed position risks seriously injuring such finger, hand or other extremity. It is for the prevention of these risks of injury, as well as other reasons that I have invented my new bi-fold door safety wedge 2 for use in combination with the bi-fold door 4.

Figure 1:
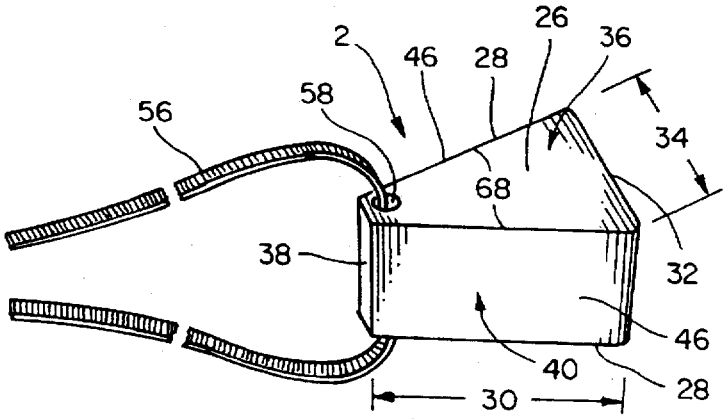
FIG. 1 is a side perspective view of my bi-fold door safety wedge in accordance with the preferred embodiment of my present invention.
Figure 2:
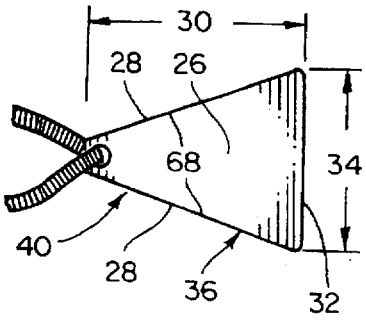
FIG. 2 is a top perspective view of my bi-fold door safety wedge shown in FIG. 1.

Referring now to FIG. 1, one will see the specific construction of my new and improved bi-fold door safety wedge 2. The safety wedge 2 comprises a main body structure 26. The main body structure 26 is defined by a pair of non-parallel edges 28. The non-parallel edges 28 are located on opposite sides of the main body structure 26 facing away from each other and extending along a length 30 of the main body structure 26. Further, the main body structure is defined by at least one other edge 32 extending along a width 34 of the main body structure between the non-parallel edges 28 at a back portion 36 of the main body structure. Although more than one other edge 32 (not specifically shown in the drawings) could extend between the non-parallel edges 28, excellent results are obtained when the one other edge 32 comprises a single edge as shown in the FIG. 1.

Excellent results are obtained when the pair of non-parallel edges 28 nearly intersect to form a snub-nosed vertex 38 at a front portion 40 of the main body structure, as shown in FIG. 1, amongst others. The snub-nosed vertex 38 is preferred because it allows a more snug relationship between the main body structure 26 and the hinge member 16 to which the main body structure is secured in operation, as hereafter explained in detail. Further, the snub-nosed vertex 38 will enhance the durability and longevity of the bi-fold door safety wedge. It should be understood, however, that a pointed vertex attained where the non-parallel edges 28 do substantially intersect (not specifically shown), could be utilized to achieve all the features of my invention, but just would not provide as snug a relationship between the main body structure and the hinge member as is provided by the snub-nosed vertex 38.

The bi-fold door safety wedge further comprises an elastic strap 56 for manually removably elastically securing the main body structure 26 to the hinge member 16. The preferred way for securing the elastic strap is to manually tie the elastic strap around the hinge with a knot 55 located adjacent a rear portion 57 of the hinge member as seen in FIG. 4, but it being understood that other ways for securing could be used equally as well to achieve the results of my invention.

The elastic strap 56 is located in the front portion 40 of the main body structure. The elastic strap 56 is preferably looped through and residing in a hole 58 in the from portion 40 of the main body structure, thereby being connected to the main body structure. It should be understood that other ways of connecting the strap 56 could be used, since it is not the particular way of connecting the strap to the main body structure that is critical as long a secure connection can be obtain therebetween. The preferred elastic strap 56 for making my invention is commonly known as polyester braided elastic sold by McMaster-Carr Supply Co. with product order/identification number 88225K11.

Referring to FIGS. 7 and 8, more critical to my invention and particularly the elastic strap 56 is that the elastic strap 56 have certain elasticity characteristics. In particular, the strap 56 should having the characteristic of automatically adjustably positioning the snub-nosed vertex 38 of the main body structure in adjacency with the hinge member 16 when the bi-fold door is in any number of the possible open positions, as shown in FIGS. 3–6. This characteristic thereby prevents the bi-fold door from being moved into the fully closed position inadvertently. That is, only when the operator intentionally grasps the main body structure, pulling it in a direction 14 out from a wedge-stopped position between the abutting longitudinal edges 12 and 13 and away from the hinge member, moving the main body structure into a non-wedged position, and then pushes or pulls the door panels causing them to move in a direction opposite 14 and moving from the front side 52 toward the back side 18, will the door move into the fully closed position shown in FIG. 8.

Further in this regard, excellent results are obtained when the elastic strap 56 has a range of elasticity enabling both snug positioning of the snub-nosed vertex 38 in adjacency with the hinge member 16 when the bi-fold door is in the open position, as shown in FIGS. 3–6, and concurrently enabling the main body structure to be manually positioned out of adjacency with the hinge member as it is moved to the non-wedged position in adjacency with the front surface of the door panels, as shown in FIGS. 7 and 8. By having a range of elasticity, the elastic strap 56 thereby allows the bi-fold door to be moved into the fully closed position, the elastic strap remaining secured to the hinge member and connected to the main body structure, and the elastic strap being stretched between respective abutting longitudinal edges 12 and 13. The bi-fold door safety wedge is then ready to assume a wedge-stopped position when the bi-fold is next opened.

A non-slip surface portion 46 is located along the length of the main body structure co-extensive with respective non-parallel edges 28. The non-slip surface portion 46 provides a contiguous relationship between the non-parallel edges 28 and respective abutting longitudinal edges 12 and 13 when the main body structure 26 is removably secured to the hinge member 16 and the bi-fold door is in a wedge-stopped position with the snub-nosed vertex 38 substantially adjacent the hinge member 16, as shown in FIGS. 3–6.

Excellent results are obtained when this contiguous relationship is defined by each point of the non-slip surface portion fully engaging an oppositely facing point on respective abutting longitudinal edges 12 and 13. Such a contiguous relationship creates a sufficient force of friction to prevent the main body portion 26 from slipping out of, or being forced out from, between the abutting longitudinal edges 12 and 13. It should be understood, however, that a less than perfect contiguous relationship between the non-parallel edges 28 and respective abutting longitudinal edges 12 and 13 will still embody the features of my invention as claimed herein.

The non-slip surface portion 46 preferably extends the entire length 30 of the main body structure 26 but it is only critical that the non-slip surface portion 46 extend a length necessary to provide a contiguous relationship creating a sufficient force of friction to prevent the main body portion 26 from slipping out of, or being forced out from, between the abutting longitudinal edges 12 and 13.

Excellent results are obtained when the non-slip surface portion 46 results from the main body structure comprising a single piece construction of uniform composition and being a rubber material, as shown in FIG. 1. Namely, the preferred rubber material for making my invention is commonly known as natural gum rubber sold by McMaster-Carr Supply Co. with product order/identification number 8633K61. Alternatively, in a second embodiment of my invention the main body structure comprises a wood or synthetic plastic material and the non-slip surface portion 46 comprises a rubber belt 66 encircling the longitudinal circumference of the main body structure. The rubber belt could be any ordinary rubber material available in the marketplace, the critical factor being that the rubber belt is sized to securely encircle the longitudinal circumference of the main body structure.

Finally, given the relationships and operation of the bi-fold door safety wedge in combination with the bi-fold door, as herebefore explained, excellent results are obtained when an angle 68 between the pair of non-parallel edges 28 is in a range of about 30 degrees to about 60 degrees. An angle in this range best insures that the main body structure will have a non-slip surface portion providing the sufficient contiguous relationship required to create the force of friction necessary to prevent the main body portion 26 from slipping out of, or being forced out from, between the abutting longitudinal edges 12 and 13. Larger angles 68 would make the bi-fold door safety wedge more likely to inadvertently slip out of, or be forced out from, between the abutting longitudinal edges 12 and 13 when the bi-fold door safety wedge is in the wedge-stopped position. Also, an angle in this range safely eliminates the creation of the pinch areas 23 that are inherent in a bi-fold door operated without the use of my inventive bi-fold door safety wedge. Too small angle 68 would result in pinch areas 23 still existing, but on a smaller scale.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. In combination, a bi-fold door safety wedge and a pivotal sliding bi-fold door mounted in a door frame having a track slidably accommodating the bi-fold door, the bi-fold door comprising at least two door panels, each of the door panels having an abutting longitudinal edge, each of the abutting longitudinal edges pivotally connected to the other abutting longitudinal edge by a hinge member fitted therebetween and located adjacent a back side of the door panel, each of the door panels further having a longitudinal leading edge facing away from the abutting longitudinal edge, the longitudinal leading edge abutting a leading surface in the door frame when the bi-fold door is in a fully closed position, the bi-fold door safety wedge comprising a main body structure, the main body structure defined by a pair of non-parallel edges on opposite sides of the main body structure facing away from each other and extending along a length of the main body structure, the main body structure further defined by one other edge extending along a width of the main body structure between the non-parallel edges at a back portion of the main body structure, the pair of non-parallel edges nearly intersecting to form a snub-nosed vertex at a from portion of the main body structure, means removably elastically securing the main body structure to the hinge member fitted between respective pivotally connected abutting longitudinal edges in the door panels, the removable elastic securing means being located in the front portion of the main body structure, the removable elastic securing means having the characteristic of adjustably positioning the snub-nosed vertex of the main body structure in adjacency with the hinge member when the bi-fold door is in an open position, a non-slip surface portion located along the length of the main body structure coextensive with the pair of non-parallel edges, said non-slip surface portion being contiguous with each abutting longitudinal edge when said main body structure is removably elastically secured to the hinge member and the bi-fold door is in a wedge-stopped position with the snub-nosed vertex adjacent the hinge member, and the removable elastic securing means further having the characteristic of enabling manual positioning of the main body structure to a non-wedged position adjacent a front side of the door panels thereby enabling the bi-fold door to be movable into the fully closed position with each abutting longitudinal edge being adjacent each respective abutting longitudinal edge and each longitudinal leading edge being adjacent each respective leading surface.

2. The combination of claim 1, wherein the main body structure is a single piece construction of uniform composition comprising a rubber material.

3. The combination of claim 1, wherein the removable elastic securing means comprises an elastic strap, the elastic strap being looped through a hole in the front portion of the main body structure and a length of the elastic strap partially residing in the hole, thereby being connected to the main body structure.

4. The combination of claim 3, wherein the elastic strap is manually securable to the hinge member, the elastic strap having a range of elasticity enabling snug positioning of the snub-nosed vertex in adjacency with the hinge member when the bi-fold door is in the open position while the elastic strap concurrently enables the snub-nosed vertex of the main body structure to be manually positioned out of adjacency with the hinge member to the non-wedged position in adjacency with the front surface of the door panels, thereby allowing the bi-fold door to be movable into the fully closed position and the elastic strap remaining secured to the hinge member and connected to the main body structure and being stretched between each abutting longitudinal edge that is adjacent each respective abutting longitudinal edge.

5. The combination of claim 1, wherein the main body structure is a material from the group consisting of wood and synthetic plastic, and the non-slip surface portion comprises a rubber belt encircling the longitudinal circumference of the main body structure.

6. The combination of claim 1, wherein an angle between the pair of non-parallel edges relative to the snub-nosed vertex is in a range of about 30 degrees to about 60 degrees.

7. In combination, a bi-fold door safety wedge and a pivotal sliding bi-fold door mounted in a door frame having a track slidably accommodating the bi-fold door, the bi-fold door comprising at least two door panels, each of the door panels having an abutting longitudinal edge, each of the abutting longitudinal edges pivotally connected to the other abutting longitudinal edge by a hinge member fired therebetween and located adjacent a back side of the door panel, each of the door panels further having a longitudinal leading edge facing away from the abutting longitudinal edge, said longitudinal leading edge abutting a leading surface in the door frame when the bi-fold door is in a fully closed position, the bi-fold door safety wedge comprising a main body structure, the main body structure defined by a pair of non-parallel edges on opposite sides of the main body structure facing away from each other and extending along the main body structure, the main body structure further defined by another edge extending between the non-parallel edges at a back portion of the main body structure, the pair of non-parallel edges intersecting to form a vertex at a front portion of the main body structure, means removably securing the main body structure to the hinge member fitted between respective pivotally connected abutting longitudinal edges in the door panels, the removable securing means having the characteristic of adjustably positioning the vertex of the main body structure in adjacency with the hinge member when the bi-fold door is in an open position, a non-slip surface portion located along the main body structure co-extensive with the pair of non-parallel edges, said non-slip surface portion being contiguous with each abutting longitudinal edge when said main body structure is removably secured to the hinge member and the bi-fold door is in a wedge-stopped position with the vertex adjacent the hinge member, and the removable securing means further having the characteristic of enabling manual positioning of the main body structure to a non-wedged position adjacent a front side of the door panels thereby enabling the bi-fold door to be movable into the fully closed position with each abutting longitudinal edge being adjacent each respective abutting longitudinal edge and each longitudinal leading edge being adjacent each respective leading surface.

8. The combination of claim 7, wherein the main body structure is a single piece construction of uniform composition comprising a rubber material.

9. The combination of claim 7, wherein the removable securing means comprises an elastic strap, the elastic strap being looped through a hole in the front portion of the main body structure and thereby being connected to the main body structure.

10. The combination of claim 9, wherein the elastic strap is manually securable to the hinge member, the elastic strap having a range of elasticity enabling snug positioning of the vertex in adjacency with the hinge member when the bi-fold door is in the open position while the elastic strap concurrently enables the snub-nosed vertex of the main body structure to be manually positioned out of adjacency with the hinge member to the non-wedged position in adjacency with the front surface of the door panels, thereby allowing the bi-fold door to be movable into the fully closed position and the elastic strap remaining secured to the hinge member and connected to the main body structure and being stretched between each abutting longitudinal edge that is adjacent each respective abutting longitudinal edge.

11. The combination of claim 7, wherein the main body structure is a material from the group consisting of wood and synthetic plastic, and the non-slip surface portion comprises a rubber belt encircling the longitudinal circumference of the main body structure.

12. In a pivotal sliding bi-fold door structure mounted in a door frame having a track slidably accommodating the bi-fold door structure, the bi-fold door structure including at least two door panels, each of the door panels having an abutting longitudinal edge, each of the abutting longitudinal edges pivotally connected to another abutting longitudinal edge by a hinge member fitted therebetween and located adjacent a back side of the door panel, each of the door panels further having a longitudinal leading edge facing away from the abutting longitudinal edge, the longitudinal leading edge abutting a leading surface in the door frame when the bi-fold door structure is in a fully closed position, wherein the improvement comprises:

a bi-fold door safety wedge including a main body structure;

the main body structure defined by a pair of non-parallel edges on opposite sides of the main body structure facing away from each other and extending along a length of the main body structure, the main body structure further defined by one other edge extending along a width of the main body structure between the non-parallel edges at a back portion of the main body structure;

the pair of non-parallel edges nearly intersecting to form a snub-nosed vertex at a front portion of the main body structure;

means removably elastically securing the main body structure to the hinge member fitted between respective pivotally connected abutting longitudinal edges in the door panels, the removable elastic seeing means being located in the front portion of the main body structure, the removable elastic securing means having the characteristic of adjustably positioning the snub-nosed vertex of the main body structure in adjacency with the hinge member when the bi-fold door structure is in an open position;

a non-slip surface portion located along the length of the main body structure coextensive with the pair of non-parallel edges, said non-slip surface portion being contiguous with each abutting longitudinal edge when said main body structure is removably elastically secured to the hinge member and the bi-fold door structure is in a wedge-stopped position with the snub-nosed vertex adjacent the hinge member; and, the removable elastic securing means further having the characteristic of enabling manual positioning of the main body structure to a non-wedged position adjacent a front side of the door panels thereby enabling the bi-fold door structure to be movable into the fully closed position with each abutting longitudinal edge being adjacent each respective abutting longitudinal edge and each longitudinal leading edge being adjacent each respective leading surface.

13. The bi-fold door structure of claim 12, wherein the main body structure is a single piece construction of uniform composition comprising a rubber material.

14. The bi-fold door structure of claim 12, wherein the removable elastic securing means comprises an elastic strap, the elastic strap being looped through a hole in the front portion of the main body structure and a length of the elastic strap partially residing in the hole, thereby being connected to the main body structure.

15. The bi-fold door structure of claim 14, wherein the elastic strap is manually securable to the hinge member, the elastic strap having a range of elasticity enabling snug positioning of the snub-nosed vertex in adjacency with the hinge member when the bi-fold door structure is in the open position while the elastic strap concurrently enables the snub-nosed vertex of the main body structure to be manually positioned out of adjacency with the hinge member to the non-wedged position in adjacency with the from surface of the door panels, thereby allowing the bi-fold door structure to be movable into the fully closed position and the elastic strap remaining secured to the hinge member and connected to the main body structure and being stretched between each abutting longitudinal edge that is adjacent each respective abutting longitudinal edge.

16. The bi-fold door structure of claim 12, wherein the main body structure is a material from the group consisting of wood and synthetic plastic, and the non-slip surface portion comprises a rubber belt encircling the longitudinal circumference of the main body structure.

17. The bi-fold door structure of claim 12, wherein an angle between the pair of non-parallel edges relative to the snub-nosed vertex is in a range of about 30 degrees to about 60 degrees.

* * * * *